US005703345A

United States Patent [19]

Gollner et al.

[11] Patent Number: 5,703,345

[45] Date of Patent: Dec. 30, 1997

[54] HYDROSTATIC DRIVE WITH DATA CARRIER CONTROL

[75] Inventors: Wilhelm Gollner, Neumunster; Manfred Maiers, Wattenbek, both of Germany

[73] Assignee: Sauer Inc., Ames, Iowa

[21] Appl. No.: 619,011

[22] Filed: Mar. 21, 1996

[30] Foreign Application Priority Data

Mar. 22, 1995 [DE] Germany ..... 195 10 430.7

[51] Int. Cl.[6] ..... G07B 15/02

[52] U.S. Cl. ..... 235/384; 235/375

[58] Field of Search ..... 235/375, 376, 235/384

[56] References Cited

U.S. PATENT DOCUMENTS 4,487,543 12/1984 Nitz ..... 414/468

*Primary Examiner*—F. L. Evans

*Attorney, Agent, or Firm*—Zarley, McKee, Thomte, Voorhees, & Sease

[57] ABSTRACT

A control system for a hydrostatically driven vehicle comprises a hydraulic drive system having a hydraulic drive unit. An electronic control unit on the machine being driven is operatively connected to the hydraulic drive unit and is adapted to transmit and receive electronically data with respect to the drive unit. An external operator control unit is comprised of a data card inserted into a manual control means and is detachably connected to the electronic control unit. The data carrier card has an interface capable of transmitting data into and receiving data from the hydraulic drive unit to the electronic control unit. The data carrier card and the external operator control unit have memory capability.

13 Claims, 2 Drawing Sheets

HYDROSTATIC DRIVE WITH DATA CARRIER CONTROL

BACKGROUND OF THE INVENTION

In industrial business as well as in the private sector the use of a data carrier for data storage and data transfer is well known. The use of a memory card for a data carrier which has a need for a card reader is very common. These card readers are available in different styles. In the future card readers with chip cards will be used more and more. A chip card can be used for electronic cash, for telephone calls or paying the bills. They can also be used as an ID-card for security or for entrance check purposes. These chip cards are used more and more electronically to obtain cash from money machines.

In the simple form for data transfer between card and control system, card readers are used. These card readers can only read the information from a chip card. For more complex functions there is a need for card readers which can read information on the chip card and which can impose data on the chip card. For communications with the chip card, card readers have a slot in which the chip card will be placed. Additionally, for fixed card readers, there is a use for mobile card readers. The use for mobile card readers is used for obtaining electronic cash as well as for other related purposes. In the Public Health area, there is a special use for doctors' home visits and emergency calls. All data, which is stored in mobile card readers must be also available on a mainframe unit. It is therefore necessary to transfer data from mobile card readers to a fixed or mobile mainframe unit. It can be also necessary to transfer data from the mainframe unit to the mobile card reader. For general use, there are possibilities for transfer of such data. With special interfaces there can be a cord or cordless data transfer. During the development of such systems there are different questions to be solved relating to safety against manipulation, and the cost considerations.

Hydrostatic drive systems are popularly controlled with digital controllers. More requests for function, safety and control require the use of digital control systems instead of analog or hydraulic controls. These systems are controlled by microprocessors or microcontrollers with special interfaces. Depending on how complex the systems are, there are different external sensors which can be connected.

There are different needs and functions which have to be solved and controlled by the system. At first there is the start-up process, where the system (the hydrostatic drive) has to be adjusted. For example the minimum and maximum position of external sensors will be read and stored in the system. During the running of the hydrostatic drive system, the system must be permanently checked and fault conditions of the system have to be in a safety mode. Also diagnostic functions with the external sensors have to be implemented in the system. These requests and functions are not 100% fulfilled in state of the art systems. Another problem is that the system is often working at a remote location, so that static or dynamic fault conditions can not be readily obtained or stored.

Another problem of existing hydrostatic drive systems is that systems with simple user interfaces (lamps) are not able to show the status or the detailed fault condition in the different user language. The systems also need considerable memory space and control software to show detailed messages. Very often digital systems are not able to solve these needs because of limited memory space and CPU power.

Therefore, a principal object of this invention is to create a hydrostatic drive system with electronic control, which is able to have a flexible control with limited hardware to provide full diagnostic and system check capabilities. It has to be flexible for different uses in different areas.

A further object of this invention is to have a flexible way to adapt the hydrostatic drive system in different working environments.

SUMMARY OF THE INVENTION

The control system for a hydrostatically driven vehicle comprises a hydraulic drive system having a hydraulic drive unit. An electronic control unit on the machine being driven is operatively connected to the hydraulic drive unit and is adapted to transmit and receive electronically data with respect to the drive unit. An external operator control unit is comprised of a data carrier card inserted into a manual control means and is detachably connected to the electronic control unit. The data carrier card has an interface capable of transmitting data into and receiving data from the hydraulic drive unit through the electronic control unit. The data carrier card and the external operator control unit have memory capability.

DESCRIPTION OF THE PREFERRED EMBODIMENT

Figure 1:
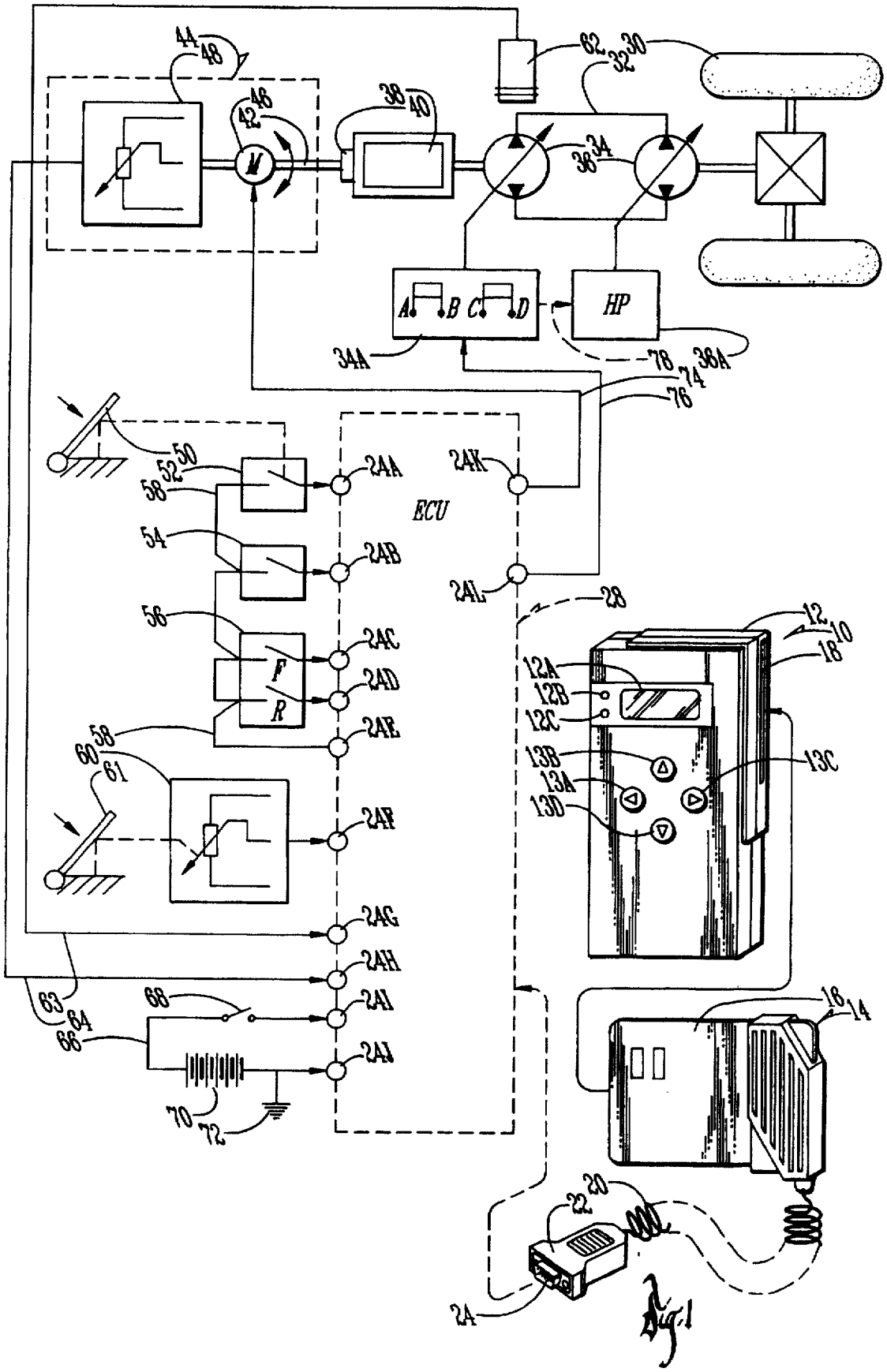
FIG. 1 is a schematic view of the circuitry of this invention.
Figure 2:
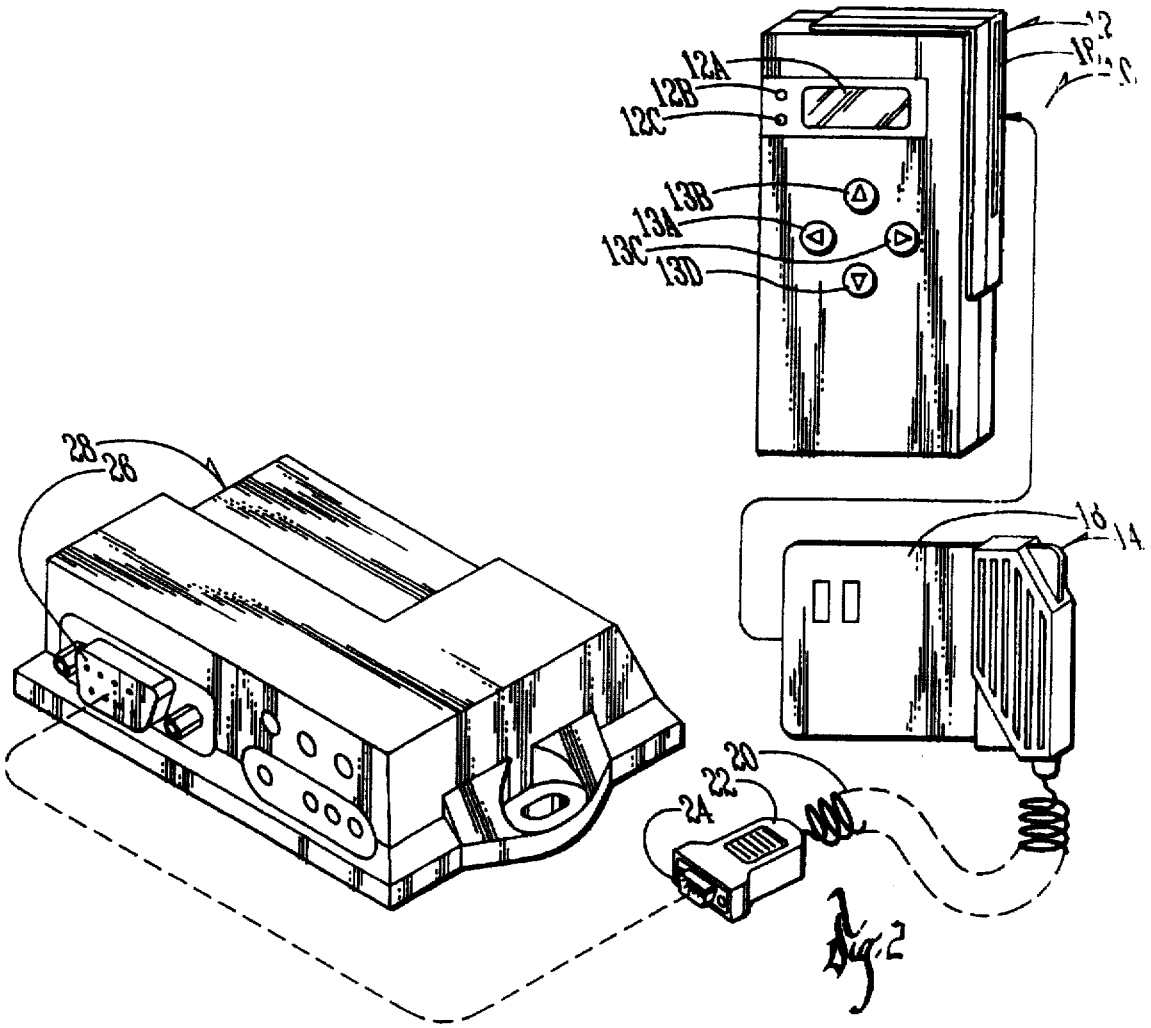
FIG. 2 is a large scale schematic perspective view of the external control mechanism and the electronic control unit.

The numeral 10 designates an external operator controlled unit comprising an electronic manual control 12 and a data carrier card 14. The electronic manual control 12 has data memory capability and has a display screen 12A, and LED 12B and 12C reflecting different colors when actuated (preferably yellow and green, respectively) and at least four operator buttons 13A, 13B, 13C and 13D. The data carrier card 14 can be either a magnetic card or a chip card both of which are capable of storing data. Card 14 has at least one interface 16 and is adapted to be inserted into slot 18 of manual control 12 wherein an internal interface (not shown) can be superimposed over interface 16. Manual control 12 is lightweight and handheld and is adapted to be manually held by a vehicle operator as will be described hereafter. Card 14 is electronically connected by line 20 to diagnostic connector 22. Connector 22 has a plurality of connector prongs 24A–24L which are adapted to be received in conventional connector sleeves 26 of electronic control unit 28 which is normally secured to the frame of wheeled vehicle 30.

Vehicle 30 has a hydraulic control unit 32 which can be either of the open or closed loop variety. Control unit 32 has control elements (e.g., swashplates) of pump 34 and motor 36. Electronic control 34A can determine the angular movement of a conventional swashplate in pump 34. Electronic control 36A is connected to the swashplate of hydraulic motor 36 to control, for example, the horsepower requirements of the hydraulic motor 36.

Vehicle 30 has a conventional engine 38 with injection pump 40. Link 42 operatively connects engine 38 to engine actuator 44. Engine actuator 44 includes a rotary actuator 46 and feed back potentiometer 48. The actuator 46 is typically connected to the throttle lever for engine 38.

Vehicle 30 includes a brake pedal 50 which is operatively connected through brake switch 52 to connector 24A of electronic control unit 28. Transport/work mode switch 54 is connected to connector 24B, and forward and reverse directional switch 56 is connected to connectors 24C and 24D, respectively. Line 58 interconnects members 52, 54 and 56 with connector 24E.

A feedback potentiometer 60 connects acceleration pedal 61 to connector 24F.

Pulse pick up unit (PPU) 62 is connected to connector 24G by line 63. Similarly, line 64 connects connector 24H to feedback potentiometer 48.

Battery circuit 66 is connected to connectors 24I and 24J. Circuit 66 includes fuse 68, battery 70 and ground 72.

Line 74 links connector 24K to rotary actuator 46 of engine actuator 44. Similarly, line 76 links connector 24L to control 34A which in turn is linked to control 36A by line 78.

The control unit 12 for the hydrostatic drive 32, has an interface to connect the unit to read or write information to the data carrier 14. The unit to read/write information pertaining to data carrier 14 is a memory card reader for chip cards such as unit 12. Data to or from the chip card can be transferred by placing the chip card in the slot of the card reader 12. The card reader is connected to the special interface of the digital control unit 28. Preferably the card reader 12 is a mobile unit with communication software and an interface to the digital control unit 28 of the hydrostatic drive 32. Preferably this interface will be used as a simple communication software interface.

Such an extremely flexible control unit has a substantial advantage to adapt the hydrostatic drive system on the different requests and needs of the customer. For example, different accelerations and deceleration can be transferred from the chip card to the control unit. These parameters can be programmed in the factory and can be changed if necessary (e.g., the operation, and the travel modes for street sweeping machines). For parameter changes the user interface is created so that a mobile card reader can be used.

This card reader 12 includes the necessary "Man-Machine-Interface". This interface has a suitable display interface 12A which can be worked by alphanumeric or graphic means. There is provided command input using buttons (13A–D) or a keyboard.

The card reader 12 can communicate with the hydrostatic control unit 28 on different levels. On the lowest level the display and the input system of the card reader is directly connected with the control software of the hydrostatic control unit. In this case the chip card 14 is not used. The hydrostatic control unit 28 transfers all user information directly to the card reader display 12A, and receives directly the information of the input system. In this simple case the hydrostatic control unit runs the main control functions. All display information must be stored in the hydrostatic control unit 28 and all must be transferred over the interface to the card reader display 12A.

On the next level, no chip card is needed. The card reader includes a fixed number of display information which is stored in a memory chip (not shown). Normally this will be an EPROM or a FLASH-Memory. The display of the information shows when the hydrostatic control unit transfers special control codes to the card reader 12.

Maximum flexibility happens on the next level. The chip card is linked in the communication protocol. All display information will be stored on the chip card and displayed with control codes. The following combinations are possible.

| Customer | User | digital control and Chip card | |
|---|---|---|---|
| A | A | A | display information A |
| B | B | A | display information B (different language) |
| B | C | A | display information C (Customer specific) |

The card reader 12 has an internal memory to store all information from the chip card 14. The chip card is placed in the card reader 12. After that the internal memory holds all display information. The input system is linked with the display information. The display menus have placeholders. When the hydrostatic control unit transfers the control code, the card reader 12 will display the special menu and the user can put parameters on the position of the placeholders. This data will be checked (range check) and then transferred to the hydrostatic control unit 28. Additionally, it is possible to create a chip card with sets of system parameters. After the system optimization process of the hydrostatic drive system, all data will be transferred from the hydrostatic control unit to the card reader and programmed to a special "parameter" chip card. On the next system start-up, this data will be transferred from the "parameter" chip card to the hydrostatic control unit.

A third kind of chip card is a system status chip card. Static and dynamic states of the system can be stored on this card. This card can then be sent for evaluation by the producer of the hydrostatic system. This kind of chip card can also be used for diagnostic functions, if there are special sensors on the hydrostatic drive system. With this chip card it is also possible to store the parameter and diagnostic data, machine access, drive performance and security data.

Another advantage of this system is, that all data from the system set-up can also be stored on the data carrier. This data can be used later as needed.

Electronic controlled variable pumps and motors will normally use electrohydraulic proportional valves. These controls have no feedback of the current setpoint. Therefore the start and endpoint of the control has a huge tolerance band. So there must be substantial compensation necessary to get acceptable tolerances. Additionally this data must be obtained and stored during the start-up phase of the system. This data at the start point will normally relate to the maximum positions of the swashplate. These maximum positions can be obtained during the vehicle test on the assembly line. Additional characteristic data curves of the unit can also be determined. Through the use of the chip card, all this information can be stored during the vehicle test on the chip card. The chip card and the unit will then be sent to the customer.

Certain predetermined data can be imposed on the interface 16 of card 14. When the operator actuates one of the control buttons such as 13A, the information from such data can be reflected on screen 12A. The LEDs 12A and 12B can advise the operator as to whether data is being sent or received to or from the electronic control unit 28. Both the card 14 and the manual control (card reader) 12 have memory capabilities as discussed above, so as to save both input and output data. This data can be called up at any time by the operator through actuation of the control buttons 13A–D, and this information can be displayed on screen 12A. Screen 12A has the capability of depicting data either in graphic or alphanumeric formats.

It is therefore seen that this invention will accomplish at least all of the stated objectives.

What is claimed is:

1. A control system for a hydrostatic drive unit, comprising, a hydrostatic drive system for propelling a wheeled machine, said drive system having a hydraulic drive unit, an electronic control unit on said machine operatively connected to said hydraulic drive unit, and being adapted to transmit and receive electronic data with respect to said hydraulic drive unit, an external operator controlled unit detachably connected to said electronic control unit, said operator controlled unit including a detachable data carrier card having an interface capable of transmitting data to and receiving data from said hydraulic drive unit through said electronic control unit.

2. The device of claim 1 wherein said operator controlled unit has a visible display means for visibly reflecting the information transmitted to or from said hydraulic drive unit.

3. The device of claim 1 wherein said operator controlled unit has manual controls wherein the operator can control the data being sent to or received from the hydraulic drive unit.

4. The device of claim 1 wherein said data carrier card has an electronic connector which is detachably connected to said electronic control unit, and said data carrier card is detachably interfaced with an interface of a manually operated control means on said operator controlled unit.

5. The device of claim 1 wherein said operator controlled unit is a hand held apparatus which is easily portable and mobile.

6. The device of claim 1 wherein said hydraulic drive unit is of the open or closed loop.

7. The device of claim 2 wherein said display means is capable of displaying graphic information.

8. The device of claim 2 wherein said display means is capable of displaying alphanumeric information.

9. The device of claim 1 wherein said external operator controlled unit has a memory means for storing data to be transmitted to said hydraulic drive unit.

10. The device of claim 1 wherein said data carrier card is a chip card.

11. The device of claim 1 wherein said data carrier card is a magnetic card.

12. The device of claim 3 wherein said operator controlled unit has read and write access to said data carrier card.

13. The device of claim 1 wherein data carrier card can electronically store data.

* * * * *